US005887531A

United States Patent [19]

Covill

[11] Patent Number: 5,887,531

[45] Date of Patent: Mar. 30, 1999

[54] FOLDING TABLE

[76] Inventor: Robin J. Covill, P.O. Box 894, Deltaville, Va. 23043

[21] Appl. No.: 912,576

[22] Filed: Aug. 18, 1997

[51] Int. Cl.[6] ..... A47B 3/00

[52] U.S. Cl. ..... 108/174; 248/168; 108/131

[58] Field of Search ..... 108/166, 167, 108/168, 169, 171, 172, 174, 173, 115, 118, 131, 128, 127; 248/432, 168, 169; 297/159

[56] References Cited

U.S. PATENT DOCUMENTS

| | | | |
|---|---|---|---|
| 2,544,228 | 3/1951 | Hoppe | 108/79 |
| 2,596,986 | 5/1952 | Curtis | 108/167 |
| 3,745,935 | 7/1973 | Douglas . | |
| 4,067,266 | 1/1978 | Lafargue . | |
| 4,068,601 | 1/1978 | Marsh et al. . | |
| 4,750,432 | 6/1988 | McNamara et al. | 108/78 |
| 5,490,467 | 2/1996 | Diffrient . | |

*Primary Examiner*—Peter M. Cuomo
*Assistant Examiner*—Gerald A. Anderson
*Attorney, Agent, or Firm*—Chase & Yakimo, L.C.

[57] ABSTRACT

A collapsible table includes a tabletop having a center leaf, intermediate first and second end leaves. First and second pairs of support arms and support legs are pivotally mounted about an axle depending from the center leaf. The arms and legs of each pair are pivotal about the axle in opposed directions between a first collapsed position and a second functional position. The support arms at the second position position the leaves attached thereto in a coplanar relationship with the center leaf. At their functional position the support legs provide underlying support to the center leaf. Slots in the arms and legs engage a key depending from the center leaf so as to maintain the arms and legs at their functional positions. A spring bias on the axle further urges the slots against the key with the weight of the center leaf urging the key into the slots. Upon lifting the center leaf the keys disengage the slots which allows the arms and legs to pivot to their collapsed positions. Guide posts on the arms and legs engage guide channels on adjacent leg surfaces so as to direct the movement of the arms and the legs between their collapsed and functional positions as well as define the limits of arm and leg pivotal movement.

24 Claims, 11 Drawing Sheets

FOLDING TABLE

BACKGROUND OF THE INVENTION

This invention relates to a folding table and, more particularly, to a table having a three-piece collapsible tabletop with support pedestal, the tabletop and pedestal being easily transformed between collapsible and functional positions.

Various forms of collapsible/folding furniture are known in the art. Although assumably effective in operation such furniture may be difficult to transform between the storage and use positions. In some cases tools may be needed to provide such a transformation. Also, prior folding tables have been directed to card tables having one-piece tabletops which were not aesthetically pleasing. Although a dining room table may have a centerpiece intermediate two leaf pieces which are pivotal between functional and collapsed positions, such a table is supported by a fixed pedestal. Accordingly, the ability to store the table in small areas was limited.

SUMMARY OF THE INVENTION

In response thereto I have invented a collapsible table having a three-piece top defined by a center leaf intermediate two leaf panels with a collapsible support pedestal. Attached to the center leaf are first and second pairs of support legs, the legs being pivotal about an axle mounted beneath the center leaf between collapsible and functional positions. First and second pairs of leaf support arms are likewise pivotal between a collapsible position underlying the center leaf and a functional position offering underlying support to the attached leaf panels. The support arms and outside support legs present guide posts which engage guide channels on the adjacent legs so that the movement of the legs and arms about the axle are guided and limited. The support legs and arms include key slots which releasably engage depending keys or the center leaf so as to preclude movement of the arms and legs from their functional positions springs in axle brackets bear against the axle to further urge the keys slots into engagement with the key with the weight of the center leaf urging the depending keys into the slots so as to maintain the arms, legs and tabletop leaves at their functional position. To collapse the table the center leaf is lifted so as to unlock the keys from the key slots which allows the arms and legs to pivot to their collapsed positions as guided and limited by the guide posts/guide channels combinations.

It is therefore a general object of this invention to provide a collapsible table or the like.

Another object of this invention is to provide a table, as aforesaid, having a three-piece tabletop, the tabletop defined by a center leaf intermediate two end leaves.

Another object of this invention is to provide a table, as aforesaid, having first and second pairs of support legs underlying the center leaf and pivotal between collapsed and functional positions.

A further object of this invention is to provide a table, as aforesaid, having first and second arm supports for providing underlying support to the end leaves, the arm supports being pivotal between collapsed and functional positions.

Another object of this invention is to provide a table, as aforesaid, the legs and arms having interengageable guide posts and guide channels therein for guiding the pivotal movement of the legs and arms between their collapsed and functional positions as well as defining the extent of pivotal movement of the legs and arms between their collapsed and functional positions.

A further object of this invention is to provide table, as aforesaid, the table having locking structure thereon for releasably maintaining the legs and arms at their functional positions.

A still further object of this invention is to provide a table locking structure, as aforesaid, the lock being in the form of a male key depending from the center leaf which are releasably engageable with female key slots in the support arms and legs.

A more particular object of this invention is to provide a table, as aforesaid, the table having a spring biased axle therein for urging the key slots against the male keys with the weight of the center leaf urging the keys into their key slots.

Another object of this invention is to provide a table with legs and arms, as aforesaid, the legs and arms being designed so as to preclude interference with the depending keys during their pivotal movement.

Still another particular object of this invention is to provide a table, as aforesaid, wherein the keys are easily removed from their key slots to allow for pivotal movement of the arms and legs to their collapsed positions.

Other objects and advantages of this invention will become apparent from the following description taken in connection with the accompanying drawings, wherein is set forth by way of illustration and example, a now preferred embodiment of this invention.

DESCRIPTION OF THE PREFERRED EMBODIMENT

Figure 1:
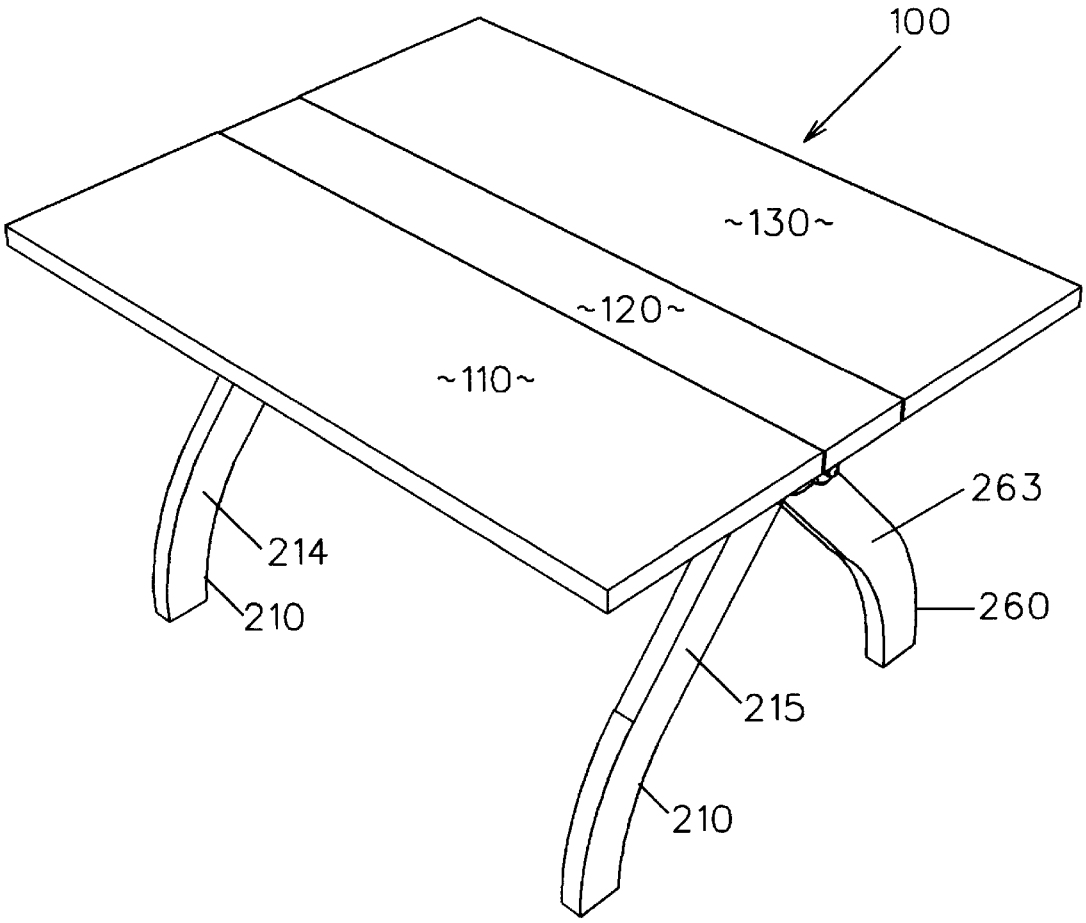
FIG. 1 is a perspective view of the table in a functional position.

Turning more particularly to the drawings, FIG. 1 illustrates the table 100 in a functional position, the tabletop having a center leaf 120 and opposed end leaves 110, 130.

Figure 2:
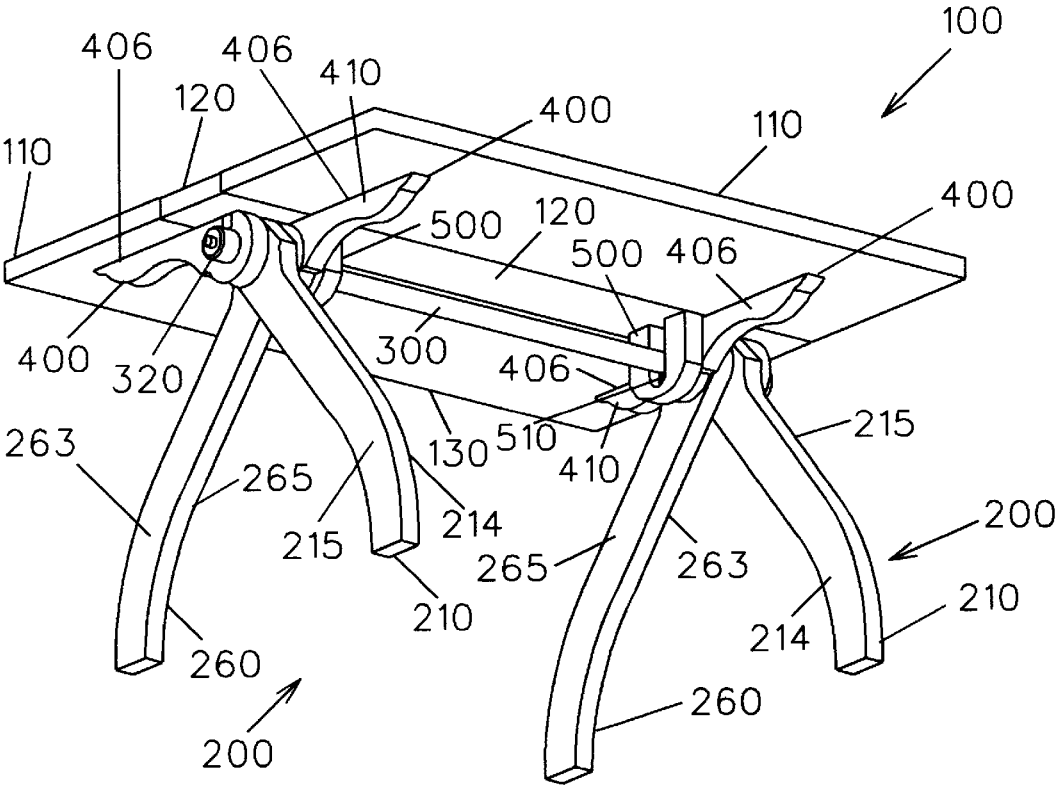
FIG. 2 is a perspective view of the table of FIG. 1 underlying the table surface so as to illustrate the tabletop support arms and legs at their functional positions.

As shown in FIG. 2, the tabletop is supported by first and second spaced-apart pairs of support legs, each pair of legs having an outside support leg 210 and an adjacent inside support leg 260 as viewed relative to an end of the center leaf 120 or the underlying axle 300 extending through legs 210, 260.

Figure 9A:
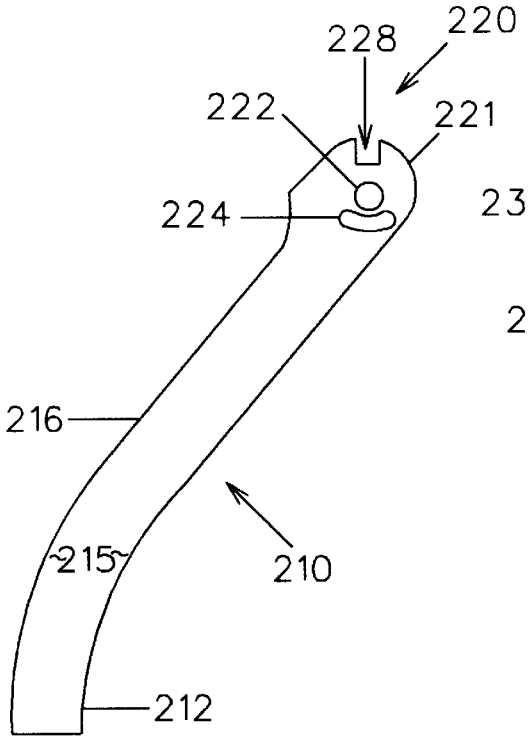
FIG. 9A is an elevation view of an outside surface of an outside support leg.
Figure 9B:
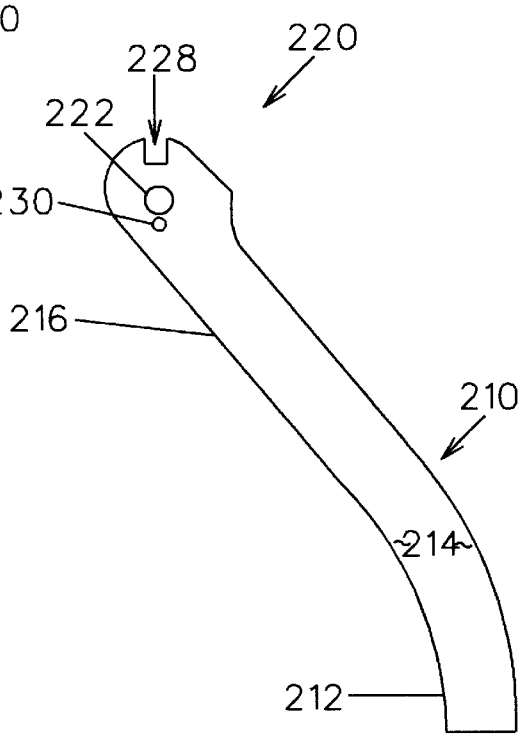
FIG. 9B is an elevation view of the inside surface of the outside support leg of FIG. 9A.

Each outside leg 210 is shown in FIGS. 9A, 9B and includes a base 212, a top 220 with an intermediate span 216 therebetween. At the top 220 is presented a lobe-like surface 221, key slot 228, axle aperture 222 and a guide channel 224 on outside surface 215. On the inside facing surface 214 of each outside leg 210 is a guide post 230.

Figure 10A:
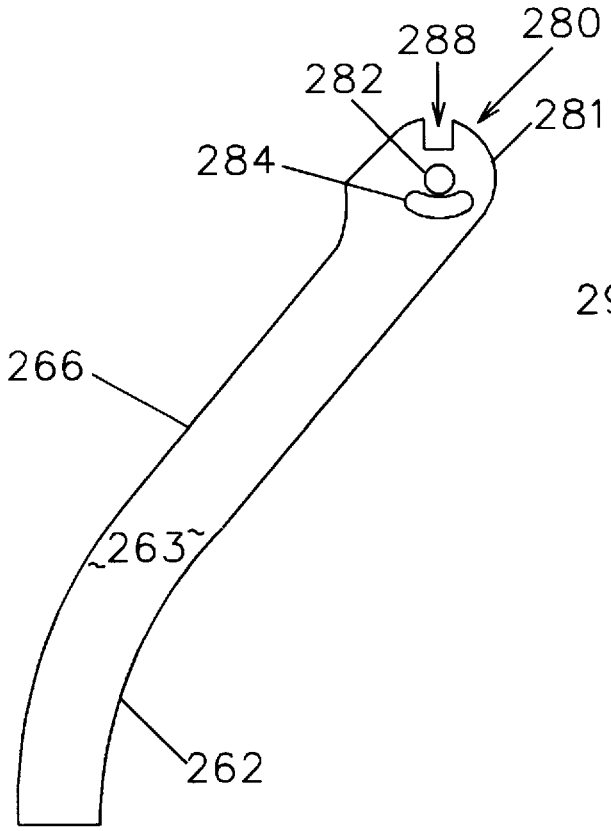
FIG. 10A is an elevation view of an inside support leg.
Figure 10B:
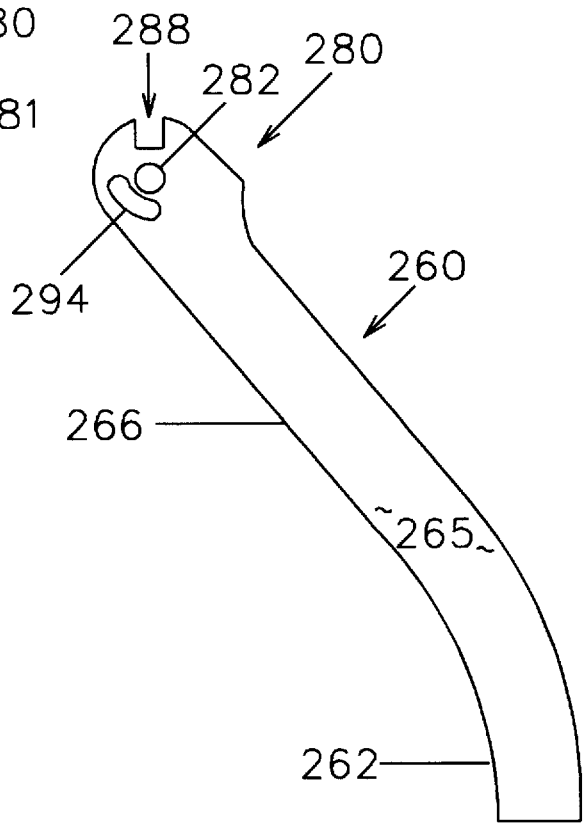
Fig. 10B is an elevation view of the inside surface of the inside support leg of FIG. 10A.

Each inside leg 260 is as shown in FIGS. 10A, 10B and includes a base 262, an intermediate span 266 and a top 280. Located at the top 280 is a lobe-like surface 281, key slot 288, an axle aperture 282 and a guide channel 284 on outside surface for engagement with the guide post 230 of leg 210. On the inside surface of inside leg 265 is a guide channel 294.

Figure 11A:
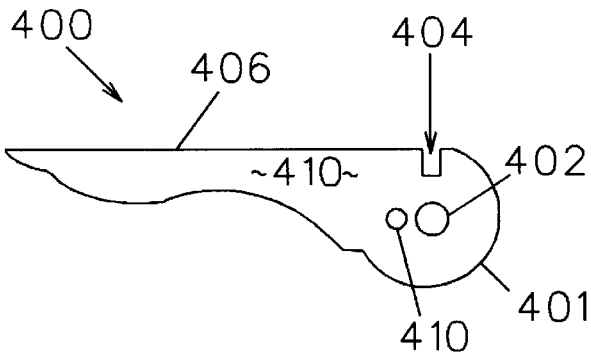
FIG. 11A is an elevation view of the inside surface of a leaf support arm.
Figure 11B:
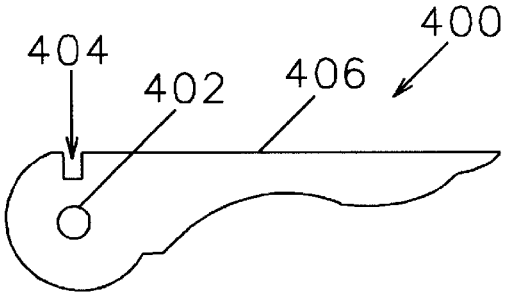
Fig. 11B is an elevation view of the outside surface of the arm of FIG. 11A.

Further shown in Figs. 11A, 11B is a leaf support arm 400 which includes a lobe-like surface 401, an axle aperture 402, key slot 404 and a leaf support surface 406. On the inside surface 410 of each leaf support arm 400 is located a guide post 410. Each arm 400 has a support surface 406 attached to the underside of a respective leaf 110, 130.

As shown in FIG. 2, upon registration of the mounting apertures 222, 282 of the outside 210 and inside 260 support legs and the apertures 402 of the outside and inside support arms 400, the guide post 410 of the outside support arm 400 is slidably seated in the guide channel 224 of the adjacent outside surface 215 of outside support leg 210. Also, the guide post 230 on the inside surface 214 of each outside leg 210 slidably seats within the guide channel 284 on the adjacent outside surface 263 of the adjacent inside leg 260. The guide post 410 on inside support arm 400 slidably seats within the channel 294 on the adjacent surface 265 of the adjacent inside leg 260.

Upon alignment of the axle apertures and extension of the axle 300 ends therethrough, collars 320 are placed at the ends thereof. The axle 300 is mounted to the underside of the center leaf 120 by means of brackets 500 which are adjacent the respective inside support arms 400. The axle 300 includes a recess/chamfer 320*a* at each end which is positioned within the confines of the slot 520 of the bracket 500. The diameter of the axle adjacent the chamfers 320*a* is greater than the width of the slot 520 to contain chamfers 320*a* within slots 520. Each bracket 500 has a tensioned spring 510 extending from the base of slot 520 with the opposed end bearing against the chamfer 320*a* located within slot.

Figure 4:
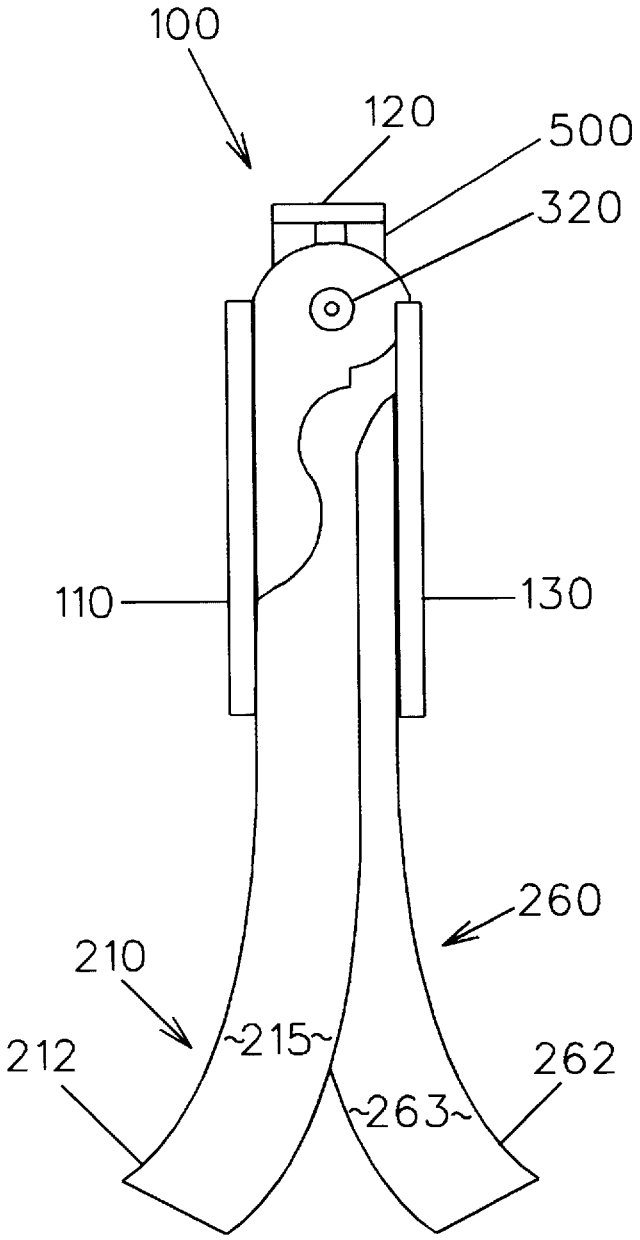
FIG. 4 is an elevation view of the left end of the table of FIG. 2 at its collapsed position.
Figure 5:
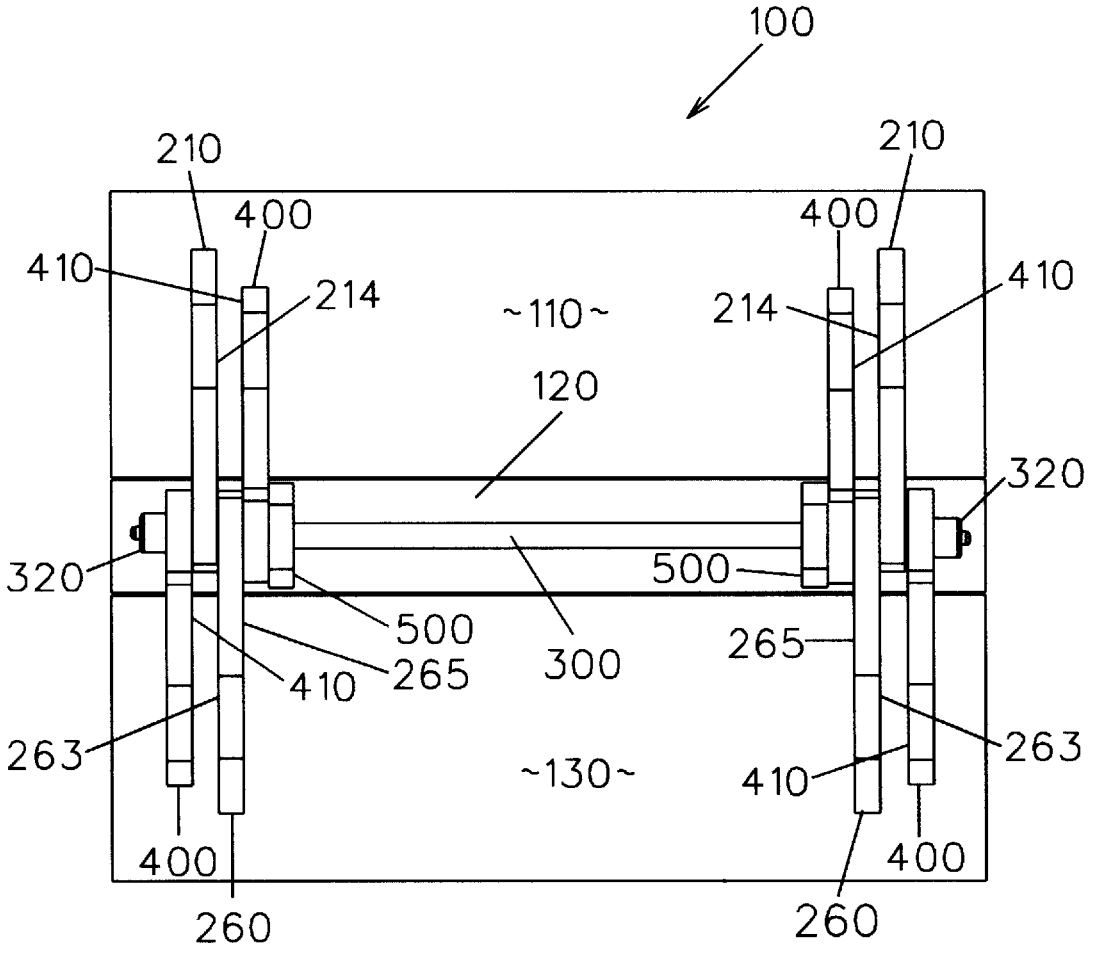
FIG. 5 is a bottom view of the tabletop of FIG. 2 at its functional position.

FIG. 4 shows the table in a collapsed position. Upon pivotal movement of the outside and inside support legs 210, 260 in opposed directions about the imaginary longitudinal axis of the axle 300 from the FIG. 4 position at which the legs overlap to a spaced-apart FIG. 1 functional position, the female key slots 228, 288 of the outside 210/inside 260 support legs receive the male keys 134, 136 depending from the center leaf 120. Such reception is enhanced by the lobe-like surfaces 231, 281 which bear against the keys 134, 136 during pivotal movement. As such the keys 134, 136 do not interfere with leg movement prior to their engagement within the key slots 228, 288.

Figure 3:
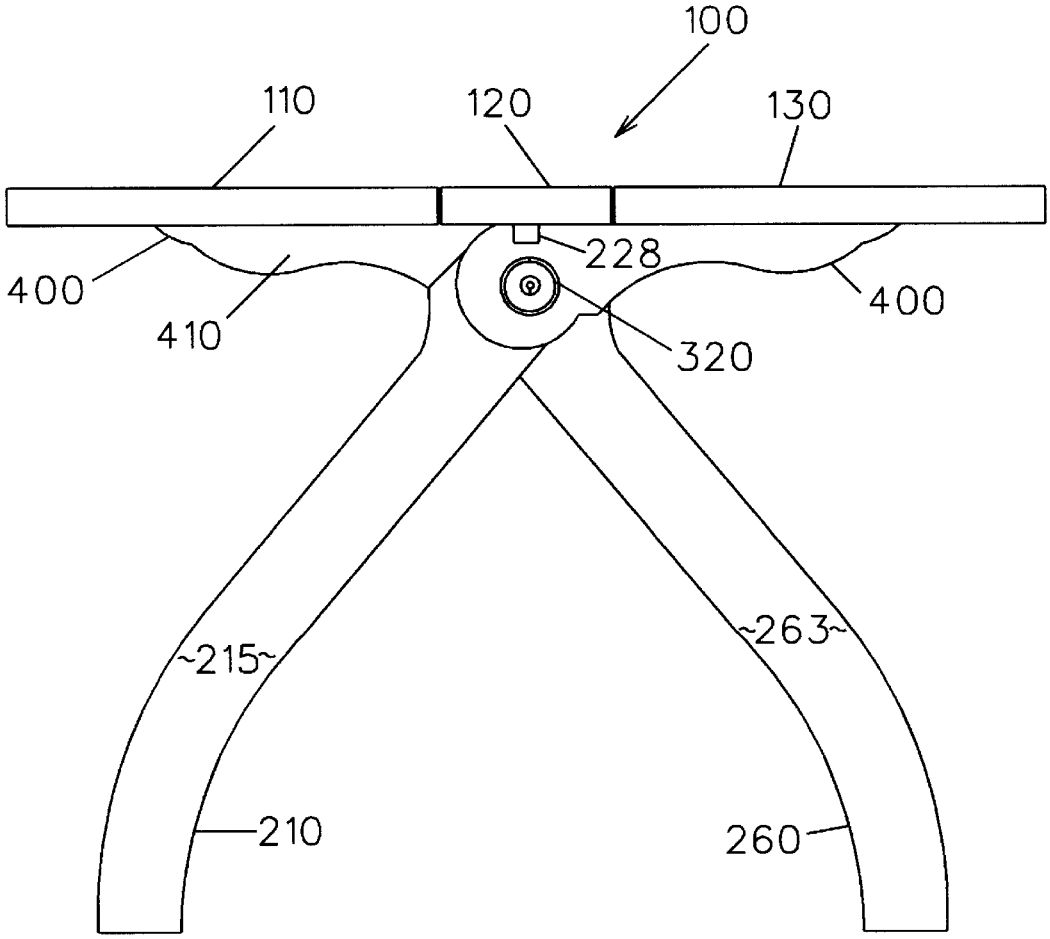
FIG. 3 is an elevation view of the right end of the table of FIG. 2 on an enlarged scale, at its functional position, the view showing one pair of outside and inside support legs and arms.
Figure 6:
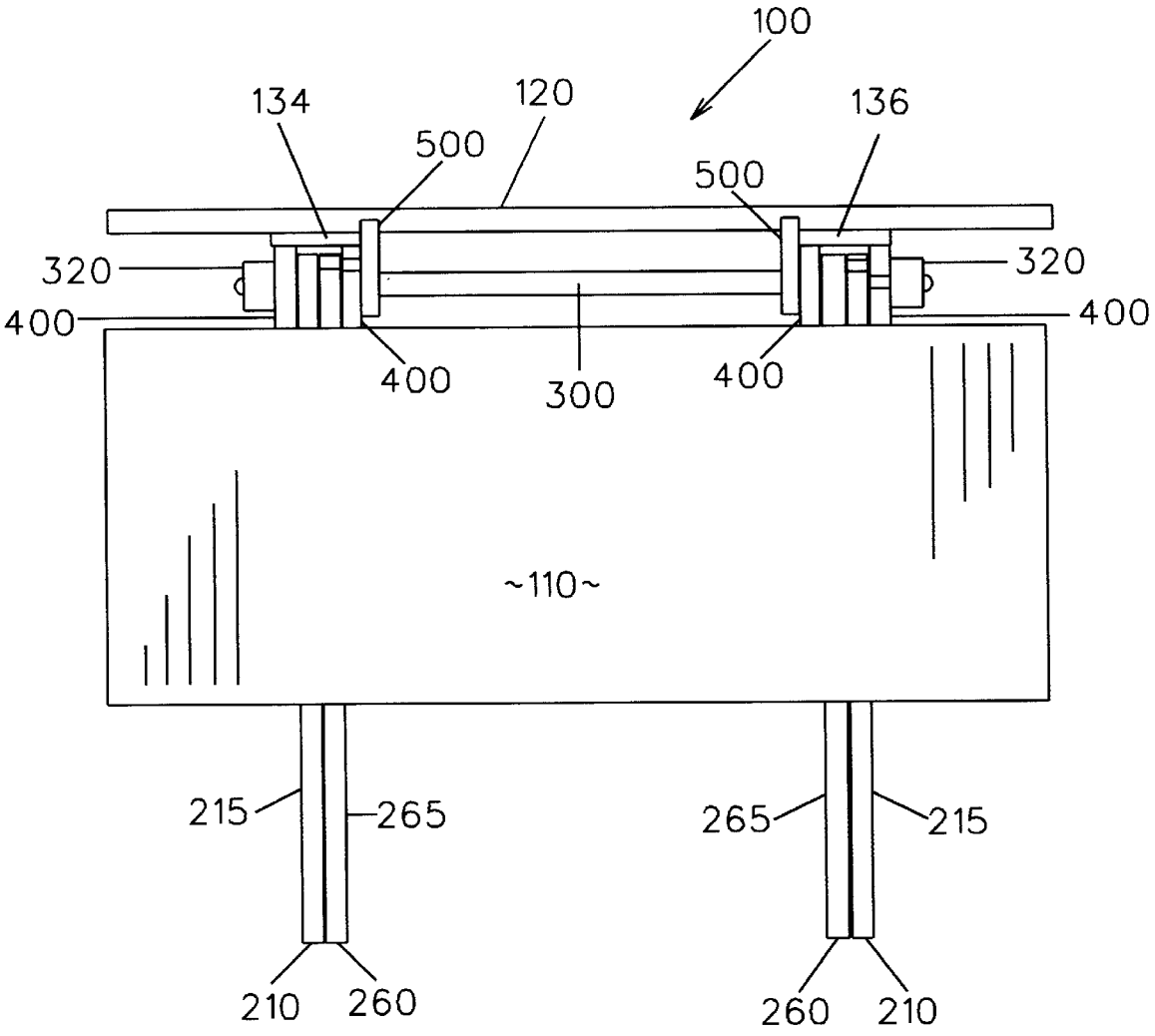
FIG. 6 is a side view of the table with one leaf being at a collapsed position.
Figure 7:
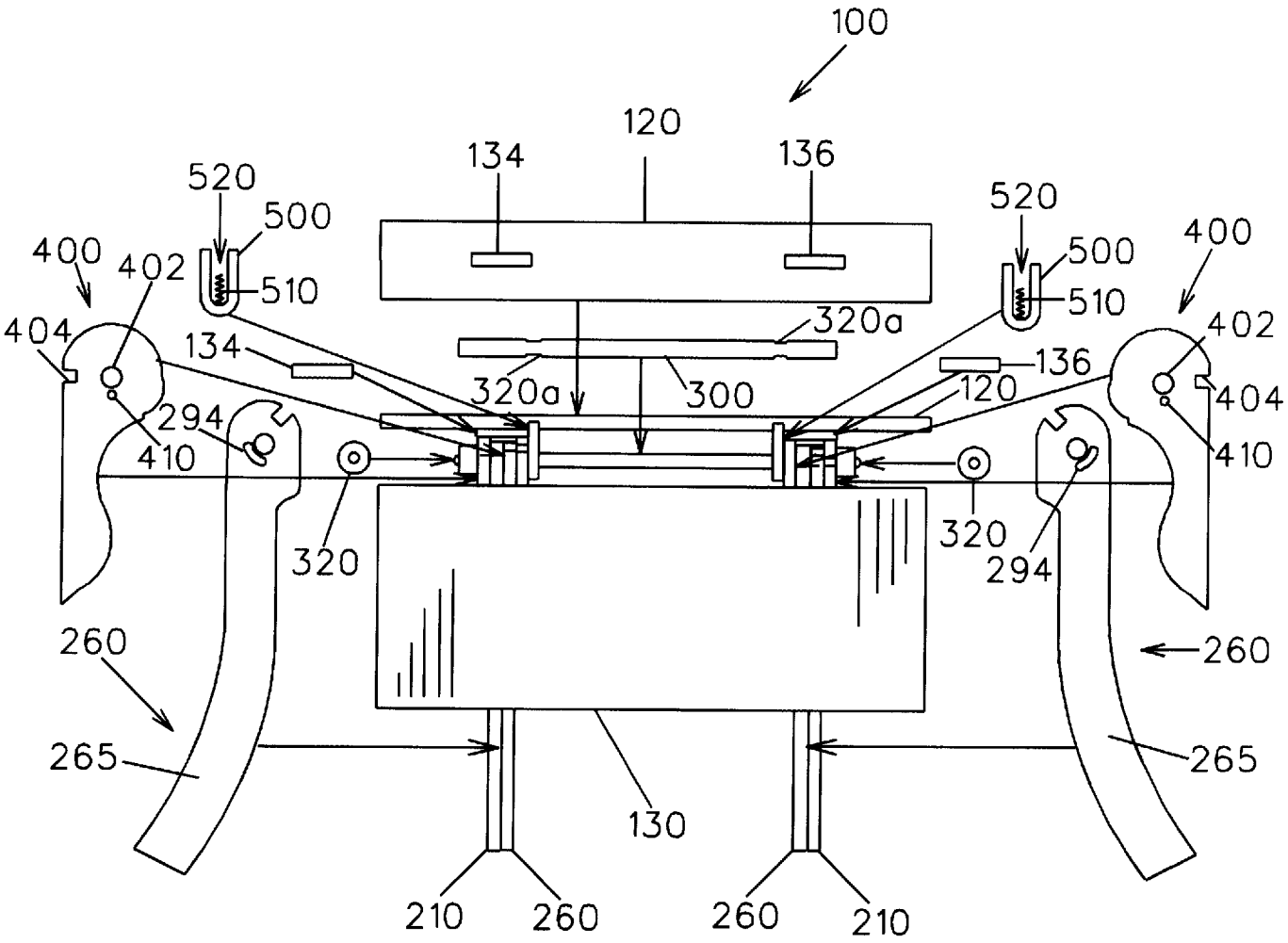
FIG. 7 is an exploded view of the table of FIG. 6 on a reduced scale with certain elements being exploded therefrom for the purposes of illustration.
Figure 8:
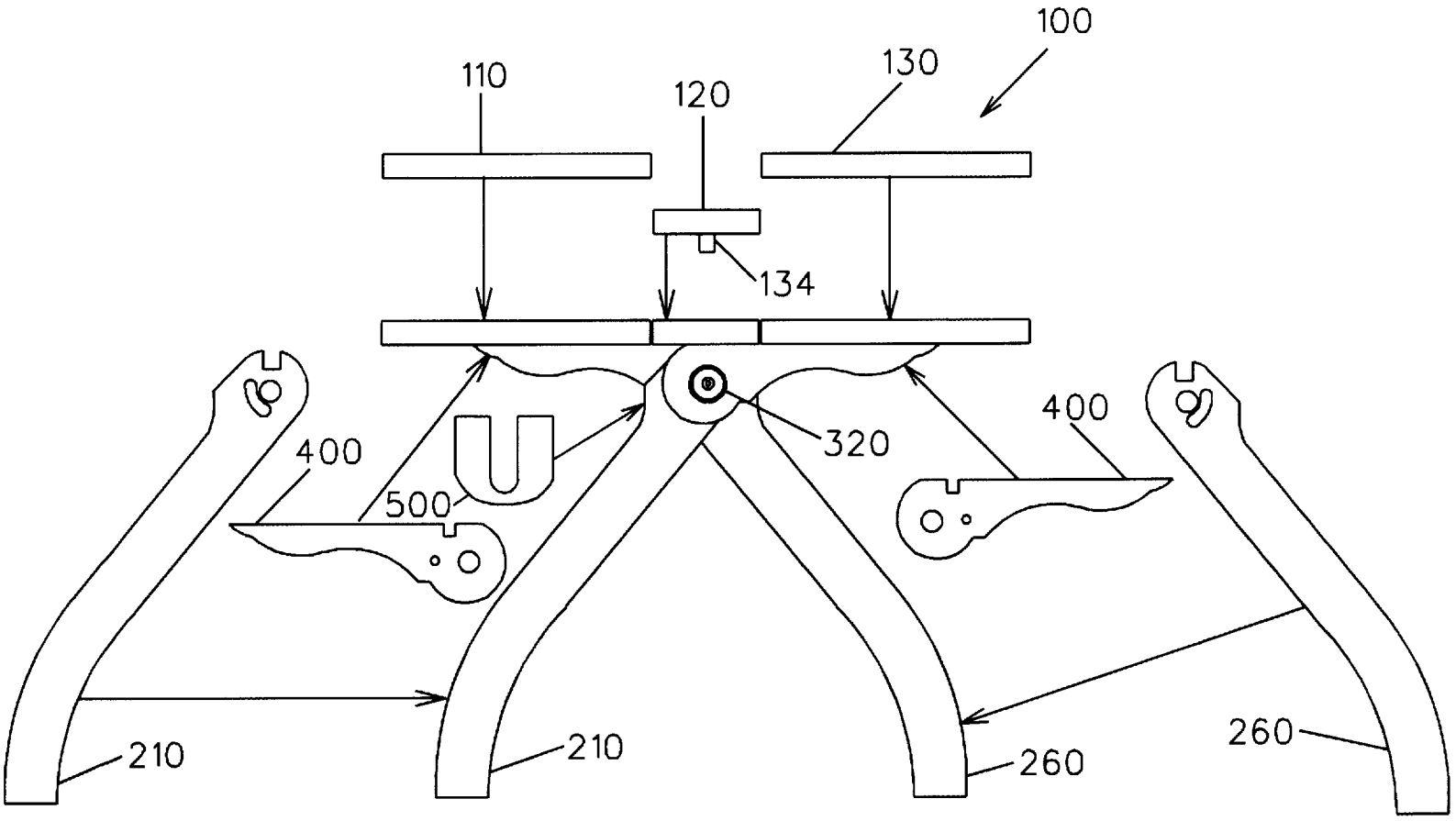
FIG. 8 is an end elevation view of the table in a functional position with certain of the elements exploded therefrom to aid in illustration.

Likewise, opposed pivotal movement of the outside and inside leaf support arms 400 from a position in which support surface 406 is generally vertical to a horizontal functional position (FIG. 6) at which the female key slots 404 also engage these depending male keys 134, 136. This movement is again enhanced by the lobe-like surface 401. At this position the attached leaves 110, 130 have been concurrently moved to a horizontal position coplanar with the center leaf 120. Engagement of the various female key slots with the depending male keys 134, 136 maintains the functional position of the tabletop leaves 110, 130 relative to center leaf 120 as collapsible movement of the legs 210, 260 and support arms 400 towards the FIG. 3 collapsed position is precluded. At this position the bracket springs 510 bear against the axle 300 so as to urge the slots of the associated arms 400 and legs 210, 260 against the depending keys 134, 136. This action cooperates with the weight of the center leaf 120 which urges the depending keys 134, 136 into the respective slots. These combined actions further maintain the key lock relationship so as to maintain the table leaves 110, 130 at their functional position.

To collapse the table the center leaf 120 is raised so as to disengage the depending keys 134, 136 from the respective key slots. Upon such disengagement the respective legs 210, 260 and the support arms 400 with attached leaves are pivotable to their FIG. 3 collapsed position, the respective lobe-like surfaces of the arms and legs upwardly urging the keys 134, 136 away from the respective slots.

During movement of the legs 210, 260 and support arms 400, the relationships of the respective guide posts 230, 410 slidably seated within the adjacent guide channels not only control the leg and arm movement between their respective collapsed and functional positions but also define the limits of such movement. Accordingly, upon each respective guide post contacting an end of its respective channel no further movement of the legs/arms about axle 300 in that direction is possible whether the legs and arms are being pivoted to either their collapsed or functional positions. Thus, it is understood that a synchronization of the cam-like relationship among the guide posts and channels is preferred such that each guide post contacts a respective one end of a channel when the table is in a functional position and contacts the opposed end of the channel when the table is at a collapsed position. Such contact assures that the tabletop and its underlying arms and legs are properly positioned when at either the functional or collapsed modes.

It is to be understood that while a certain form of this invention has been illustrated and described, it is not limited thereto except insofar as such limitations are included in the following claims and allowable functional equivalents thereof.

Having thus described the invention, what is claimed as new and desired to be secured by Letters Patent is as follows:

1. A folding table comprising:

a tabletop comprising first and second end leaves with a center leaf having opposed ends, said center leaf intermediate said first and second end leaves;

an axle;

means for mounting said axle to an underside of said center leaf;

first and second pairs of support legs at said center leaf opposed ends, each pair of support legs having an outside leg and an adjacent inside leg relative to one of said opposed ends of said center leaf, each leg comprising:

a top end pivotally mounted about said axle;

a base, each pair of legs movable about said axle between a first collapsible position with said base of each leg overlapping and a second functional position with said leg bases displaced from each other, said second position of said legs supporting said center leaf;

a guide channel in a surface of each inside leg of each pair of legs;

a guide post on each outside leg for slidably engaging said guide channel in said adjacent inside leg during said leg pivotal movement about said axle;

a guide channel in a surface of each outside leg;

first and second pairs of support arms pivotally mounted about said axle between a first collapsible position generally depending from said axle and a second functional position displaced from said first arm position, each pair of support arms having an inside support arm adjacent said inside leg of each leg pair and an outside support arm adjacent said outside leg of each leg pair;

a guide post on each of said outside support arms for slidably engaging said guide channel on said adjacent outside leg during said arm pivotal movement;

means for mounting said first leaf to said outside support arms;

means for mounting said second leaf to said inside support arms;

means for locking said support arms at said support arm second position whereat said leaves attached thereto are generally coplanar with said center leaf;

means for maintaining said support legs at said second position, whereby to support a generally coplanar horizontal tabletop.

2. The table as claimed in claim 1 wherein said support arm locking means comprises:

a key lug depending from said center leaf;

means on each support arm for releasably engaging said key lug at said second functional position of each support arm, said engagement precluding further pivotal movement of said support arms.

3. The table as claimed in claim 2 wherein said support arm engaging means comprises a slot in each arm for releasably receiving said key lug therein.

4. The table as claimed in claim 3 further comprising means associated with said center leaf for maintaining said key lug in said slots of said support arms.

5. The table as claimed in claim 4 wherein said key lug maintaining means comprises:

first and second brackets depending from said center leaf;

an aperture in each bracket for receiving an end of said axle therethrough;

a spring having a first end attached to said bracket and a second end bearing against said axle, said spring having a bias for urging said axle in a direction to urge said slots of said arms mounted to said axle against said key lugs in said slots of said support arms.

6. The table as claimed in claim 5 wherein said center leaf is movable by a user in a direction to release said key lug from said respective slots of said arms and legs, whereby to allow for pivotal movement of said support arms and said legs from said second functional position to said first collapsed position.

7. The table as claimed in claim 1 wherein each guide channel on said inside and outside legs has first and second ends, one of said ends of each of said guide channels contacting said respective guide post slidably engaged therein upon said support arms and legs reaching said first position, said respective guide post contacting an opposed end of said respective guide channel upon reaching said second position, whereby to preclude pivotal movement of said associated support arms and support legs beyond said first and second positions upon said contact of said respective guide posts with said guide channel ends.

8. The table as claimed in claim 2 wherein said maintaining means on each support leg comprises:

means on each leg for releasably engaging said key lug at said second functional position of each leg, said engagement precluding further pivotal movement of said leg.

9. The table as claimed in claim 8 wherein said engaging means on each support leg comprises a slot in each leg for releasably receiving said key lug therein.

10. The table as claimed in claim 9 further comprising means associated with said center leaf for maintaining said key lug in said slots of said support legs.

11. The table as claimed in claim 10 wherein said means for maintaining said key lug in said slot of said support legs comprises:

first and second brackets depending from said center leaf;

an aperture in each bracket for receiving an axle end therethrough;

a spring having a first end attached to said bracket and a second end bearing against said axle, said spring urging said axle in a direction to urge said slots of said legs mounted to said axle against said key lugs in said slots of said support legs.

12. The table as claimed in claim 11 wherein said center leaf is movable by a user in a direction to release said key lug from said respective slots of said arms and legs, whereby to allow for pivotal movement of said support arms and said legs from said second functional position to said first collapsed position.

13. The table as claimed in claim 1 wherein said support leg maintaining means comprises:

a key lug depending from said center leaf;

means on each support leg for releasably engaging said key lug at said second functional position of each leg, said engagement precluding further pivotal movement of said support legs.

14. The table as claimed in claim 13 wherein said engaging means on each support leg comprises a slot in each leg for releasably receiving said key lug therein.

15. The table as claimed in claim 1 further comprising:

a second guide channel in an opposed surface of each inside leg of each pair of legs;

a guide post on each of said inside support arms for slidably engaging said second guide channel in said opposed surface of each inside leg of each pair of legs.

16. A folding table comprising:

a tabletop comprising first and second end leaves with a center leaf having opposed ends, said center leaf intermediate said first and second end leaves;

first and second spaced-apart pairs of support legs, each leg having a base for contact with an underlying support surface, each pair of support legs having an outside leg and an adjacent inside leg relative to one of said opposed ends of said center leaf;

means for pivotally mounting said first and second pairs of support legs to said center leaf between a first collapsible position wherein said support leg bases are generally underneath said center leaf and a second functional position with said bases spaced apart beyond an imaginary central axis of said center leaf for supporting said center leaf;

first and second pairs of support arms, each pair of support arms having an inside support arm adjacent said inside leg of each leg pair and an outside support arm adjacent said outside leg of each leg pair;

means for mounting one of said first or second end leaves to said outside support arms;

means for mounting the other of said first or second end leaves to said inside support arms;

means for pivotally mounting said pairs of support arms to said center leaf between a first collapsible position wherein each attached leaf is at a vertical position and a second functional position wherein each attached leaf is generally coplanar with said center leaf;

means for maintaining said support legs at said second position whereby to support a generally coplanar tabletop; and means for locking said support arms at said second position to maintain said first and second leaves at said generally coplanar position with said center leaf.

17. The table as claimed in claim 16 wherein said support leg maintaining means comprises male fastener means on either said center leaf or on said support legs for engagement with complementary female fastener means on either said support legs or said center leaf for engagement therebetween upon said support legs reaching said second position, said engagement precluding further movement of said support legs.

18. The table as claimed in claim 17 wherein said female fastener means of said support leg maintaining means comprises a slot with said male fastener means comprising a lug adapted to fit within said slot.

19. The table as claimed in claim 16 wherein said support arm locking means comprises male fastener means on either said center leaf or on said support arms for engagement with complementary female fastener means on either said support arms or said center leaf for engagement therebetween upon said support legs reaching said second position, said engagement precluding further movement of said support arms.

20. The table as claimed in claim 19 wherein said female fastener means of said support leg locking means comprises a slot with said male fastener means comprising a lug adapted to fit within said slot.

21. The table as claimed in claim 16 further comprising means on said support legs for precluding pivotal movement of said first and second pairs of support legs beyond said first and second support leg positions.

22. The table as claimed in claim 21 further comprising means on said support arms and said support legs for precluding movement of said first and second pairs of support arms beyond said first and second support arm positions.

23. The table as claimed in claim 16 further comprising means on said support arms and said support legs for precluding movement of said first and second pairs of support arms beyond said first and second support arm positions.

24. A folding table comprising:

a tabletop comprising first and second end leaves with a center leaf having opposed ends, said center leaf intermediate said first and second end leaves;

an axle;

means for mounting said axle to an underside of said center leaf;

first and second pairs of support legs at said center leaf opposed ends, each pair of support legs having an outside leg and an adjacent inside leg relative to one of said opposed ends of said center leaf, each leg comprising:

a top end pivotally mounted about said axle;

a base, each pair of legs movable between a first collapsible position with said base of each leg overlapping and a second functional position with said leg bases displaced from each other, said second position of said legs supporting said center leaf;

means on opposed surfaces of each inside leg of each pair of legs for presenting a channel therealong;

means on each outside leg for slidable movement along one of said channel presenting means on said adjacent inside leg surface during said leg pivotal movement;

means on a surface of each outside leg for presenting a channel therealong;

first and second pairs of support arms pivotally mounted about said axle between a first collapsible position generally depending from said axle and a second functional position displaced from said first arm position, each pair of support arms having an inside support arm adjacent said inside leg of each leg pair and an outside support arm adjacent said outside leg of each leg pair;

means on each of said outside support arms for slidable movement along said channel presenting means on said adjacent outside leg surface during said arm pivotal movement;

means on each of said inside support arms for slidable movement along said channel presenting means on said adjacent inside leg surface during said arm pivotal movement;

means for mounting one of said first or second end leaves to said outside support arm;

means for mounting the other of said first or second end leaves to said outside support arms;

means for locking said support arms at said support arm second position whereat said respective leaf attached thereto is generally coplanar with said center leaf;

means for maintaining said support legs at said second support leg position, whereby to support a generally coplanar horizontal tabletop comprising said first, center and second leaves.

* * * * *